US005712647A

United States Patent [19]

Shively

[11] Patent Number: 5,712,647

[45] Date of Patent: Jan. 27, 1998

[54] SPIRAL MICROSTRIP ANTENNA WITH RESISTANCE

[75] Inventor: David G. Shively, Hampton, Va.

[73] Assignee: The United States of America as represented by the Administrator of the National Aeronautics and Space Administration, Washington, D.C.

[21] Appl. No.: 633,713

[22] Filed: Apr. 17, 1996

Related U.S. Application Data

[63] Continuation of Ser. No. 269,268, Jun. 28, 1994, abandoned.

[51] Int. Cl.[6] ..... H01Q 1/36

[52] U.S. Cl. ..... 343/895; 343/700 MS

[58] Field of Search ..... 343/895, 700 MS; H01Q 1/36

[56] References Cited

U.S. PATENT DOCUMENTS

| | | | |
|---|---|---|---|
| 3,787,871 | 1/1974 | Reese | 343/895 |
| 3,972,755 | 8/1976 | Misfeldt | 156/3 |
| 4,387,374 | 6/1983 | Hardie | 343/895 |
| 5,170,175 | 12/1992 | Kobus et al. | 343/895 |
| 5,223,849 | 6/1993 | Kasevich et al. | 343/895 |
| 5,313,216 | 5/1994 | Wang et al. | 343/895 |

OTHER PUBLICATIONS

H. Nakano, *Helical and Spiral Antennas—A Numerical Approach*, John Whiley and Sons, Inc., New York, 1987.

H. Nakano, et al., "A Spiral Antenna Backed by a Perfectly Conducting Plane Reflector," *IEEE Trans. on Ant. and Prop.*, vol. 34, No. 6, pp. 791–796, Jun. 1986.

J.J.H Wang and V.K. Tripp, "Design of Multictave Spiral-Mode Microstrip Antennas," *IEEE Trans. on Ant. and Prop.*, vol. 39, No. 3, pp. 332–335, Mar. 1991.

*Primary Examiner*—Hoanganh T. Le
*Attorney, Agent, or Firm*—Robin W. Edwards

[57] ABSTRACT

A spiral microstrip antenna having resistor elements embedded in each of the spiral arms is provided. The antenna is constructed using a conductive back plane as a base. The back plane supports a dielectric slab having a thickness between one-sixteenth and one-quarter of an inch. A square spiral, having either two or four arms, is attached to the dielectric slab. Each arm of the spiral has resistor elements thereby dissipating an excess energy not already emitted through radiation. The entire configuration provides a thin, flat, high gain, wide bandwidth antenna which requires no underlying cavity. The configuration allows the antenna to be mounted conformably on an aircraft surface.

7 Claims, 6 Drawing Sheets

SPIRAL MICROSTRIP ANTENNA WITH RESISTANCE

This is a continuation of application Ser. No. 08/269,268 filed on Jun. 28, 1994 now abandoned.

ORIGIN OF THE INVENTION

The invention described herein was made by an employee of the United States Government and may be manufactured and used by or for the Government for any governmental purpose without payment of any royalties thereon or therefor.

BACKGROUND OF THE INVENTION

The invention relates to microstrip antennas, and more particularly to wide bandwidth spiral antennas with resistive loading.

The advent of spread spectrum, frequency-hopping transmitters and receivers, used in jam resistant voice and data transmissions and in various radar applications, has created a requirement for wideband, high gain antennas. Additionally, as many of these antennas are mounted on aircraft, it is desirable to have a relatively thin, flat antenna which can be mounted in a conformal patch to a fuselage or wing section. Among the prior art devices are several types of spiral antennas.

Spiral antennas are inexpensive, low profile, wideband radiators. Most commercially available spiral antennas cover a 10:1 frequency range and are backed by a cavity which is filled with electrically lossy material. For spirals operating at microwave frequencies, the cavity is typically one or two inches in depth. The fields in the cavity are dissipated in order to minimize the effects of the cavity on the radiated fields. Although the lossy cavity enhances the wideband performance of the antenna, it also lowers the gain of the antenna. Circular Archimedean and circular equiangular spirals are most common, but square spirals and zig-zag spirals also offer wideband performance. Please see H. Nakano, *Helical and Spiral Antennas—A Numerical Approach,* John Wiley and Sons, Inc., New York, 1987.

Recent scientific investigations indicate that the lossy cavity behind the spiral can be eliminated. For example, an Archimedean spiral above a perfectly conducting ground plane has been analyzed and shown to provide limited bandwidth. See H. Nakano, et al., "A Spiral Antenna Backed by a Perfectly Conducting Plane Reflector," *IEEE Trans. on Ant. and Prop.,* Vol. 34, No. 6, pp. 791–796, June 1986.

Wang and Tripp have developed a microstrip type of spiral antenna covering a 6:1 frequency band and producing a significantly higher gain than the conventional cavity-backed spiral. The Wang and Tripp spirals include both Archimedean and equiangular spirals placed on dielectric slabs and backed by a ground plane. The dielectric thickness required for these spirals is 1/10 to 1/4 of an inch. Lossy material is still required around the circumference of the spirals however, in order to absorb unwanted energy in higher order modes. This requirement for lossy materials arises because of the operation of the spiral. During the typical operation, radiation from the spiral will occur at a particular location on the spiral along a length of the arms depending on the frequency. At higher frequencies, the radiation occurs nearer the center of the spiral (equivalent to a shorter antenna length). At lower frequencies, the radiation occurs further out on the spiral, thereby acting as a longer antenna length. The problem occurs when energy reaches the end of the spiral arms and is reflected back through the spiral towards the center. The reflected energy degrades the transmission and causes a substantial reduction in performance. This characteristic means the energy in the antenna must be either radiated or dissipated prior to the end of the spiral regardless of frequency. The prior art method of accomplishing this result is to use lossy material behind the spiral to absorb part of the antenna energy as previously discussed. Without the use of lossy material the antenna is limited to higher frequencies where the energy is completely radiated away. At lower frequencies, the interference degrades the radiation, effectively limiting the bandwidth. If lossy material is used, bandwidth increases, but the gain of the antenna is reduced mostly at lower frequencies. Additionally, the use of lossy materials requires a thickness in the antenna assembly which precludes conformal mounting.

SUMMARY OF THE INVENTION

Accordingly, it is an object of the present invention to provide a spiral antenna having a wide bandwidth and a high gain.

It is another object of the invention to provide a spiral antenna having a thin, flat structure suitable for conformal mounting.

It is yet another object of the invention to provide a spiral antenna which has an increasing dissipation of excess energy as the position along the spiral arms is increased.

It is a further object of the invention to provide a wideband, high gain antenna without the use of electrically lossy material behind the spiral antenna.

The invention is a square spiral antenna placed on a dielectric slab backed by a ground plane. The spiral comprises either two or four or more paired arms winding outward from the spiral center. Each arm has resistor elements located so as to reduce resistive losses at the higher frequencies, but to preclude reflections at the end of the spiral arms. The resistive effect is achieved by either a tapered increasing resistance or, alternately, by step increases in resistance, the steps increasing in magnitude, as the energy travels from the center to the outer edges of the spiral.

BRIEF DESCRIPTION OF THE DRAWINGS

For a more complete understanding of the present invention and for further objects and advantages thereof, reference is now made to the following description taken in conjunction with the accompanying drawings in which.

DETAILED DESCRIPTION OF THE INVENTION

Figure 1:
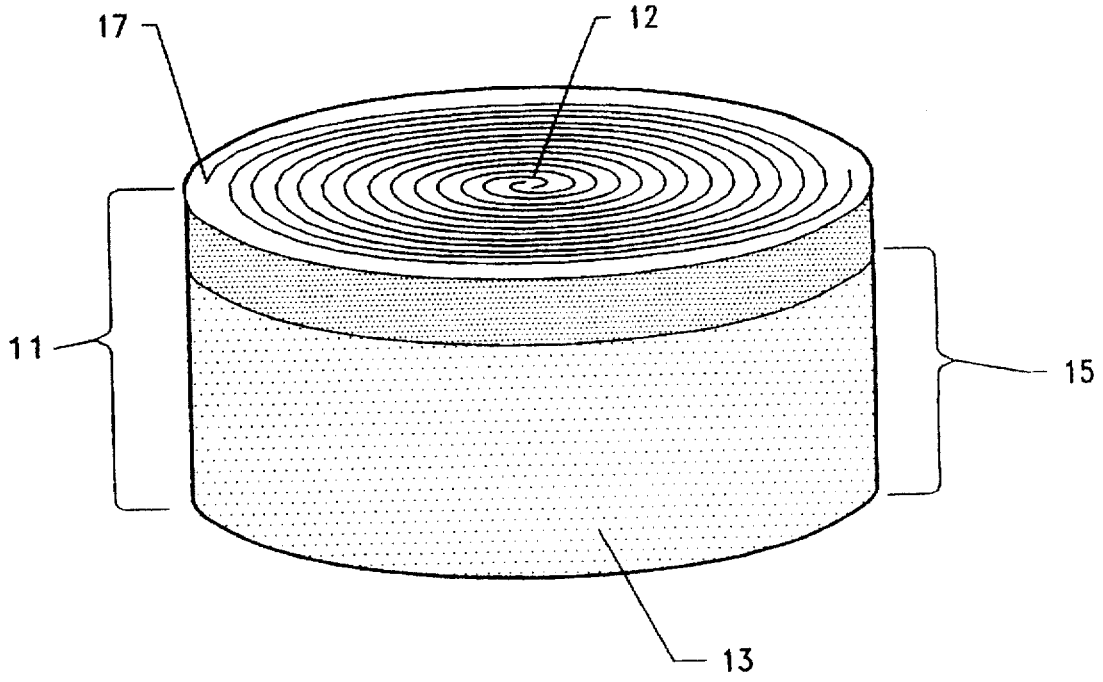
PRIOR ART FIG. 1
FIG. 1 is a perspective view of a prior art conventional cavity-backed spiral antenna.

A conventional prior art spiral antenna 11 is shown in FIG. 1. The spiral 12 is located above a metallic cavity 15 which is filled with electrically lossy material 13, and is usually 1–2 inches deep. The spiral radiates in both directions perpendicular to the plane of the spiral. Radiation in the downward direction is absorbed in the lossy material 13. Because the lossy material inside the cavity reduces the antenna current to zero by the end 17 of the spiral and eliminates any reflection in the cavity, a wide bandwidth radiation is achieved, covering for example 2 to 20 GHz, but with poor gain characteristics. In this type of antenna, ½ of the input power is lost through absorbed back plane radiation.

Figure 2:
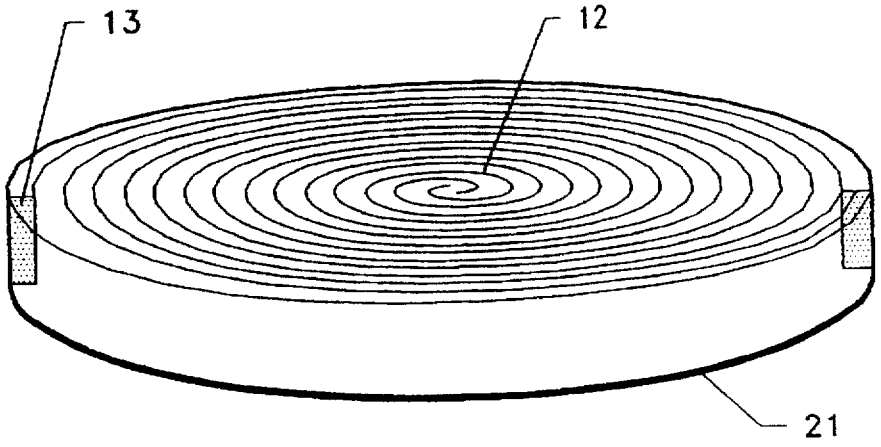
PRIOR ART FIG. 2
FIG. 2 is a partial cutaway view of a prior art spiral antenna using lossy material with a backplane.

An alternative prior art device aimed at reducing back plane losses is shown in FIG. 2. In this device, the spiral antenna 12 is mounted over a conductive ground plane 21 with electrically lossy material 13 formed underneath the outer circumference of the spiral 12. This lossy material has the same effect as the lossy material in the cavity in the case of the previous spiral. This spiral (FIG. 2) is much thinner, however, typically only ¼ inch. This type of antenna provides somewhat greater gain that the spiral in FIG. 1, while still providing a relatively wide bandwidth. Typically, the cavity backed spiral has a 10:1 bandwidth whereas the spiral with a backplane and circumferential lossy material has a 6:1 bandwidth. In developing a better solution to the gain (bandwidth) problem, a method of moments analysis computer program has been used to model a new spiral antenna.

The analysis involves the use of spectral domain Green's functions to predict the electric field produced by an electric current element located on a dielectric slab which is backed by a perfectly conducting ground plane. In this way, the currents and fields of a spiral are rigorously modeled. The method also models any resistance which is located on the arms of the spiral. A system of simultaneous equations results, with the unknown being the coefficients of the electrical current on the spiral arms. The system of equations is solved on a computer using standard matrix solvers. The system of equations is as follows:

$$\vec{E}_t^{inc}(x,y)+\vec{E}_t^{scat}(x,y)=R(x,y)\vec{J}_s(x,y)$$

$$\begin{bmatrix} V_x^{pq} \\ V_y^{pq} \end{bmatrix}=\begin{bmatrix} Z_{xx}^{pqmn} & Z_{xy}^{pqmn} \\ Z_{yx}^{pqmn} & Z_{yy}^{pqmn} \end{bmatrix}\begin{bmatrix} I_x^{mn} \\ I_y^{mn} \end{bmatrix}+\begin{bmatrix} R_{xx}^{pqmn} & 0 \\ 0 & R_{yy}^{pqmn} \end{bmatrix}\begin{bmatrix} I_x^{mn} \\ I_y^{mn} \end{bmatrix}$$

$$V_x^{pq}=\int_{x_p-\Delta x}^{x_p+\Delta x}\int_{y_q-\Delta y}^{y_q} E_x^{inc}(x,y)f_x^{pq}(x,y)dydx$$

$$Z_{xx}^{pqmn}=\frac{1}{4\pi^2}\int_{-\infty}^{\infty}\int_{-\infty}^{\infty} G_{xx}(k_x,k_y)\tilde{f}_x^{mn}(k_x,k_y)\tilde{f}_x^{pq}(k_x,k_y)dk_xdk_y$$

$$R_{xx}^{pqmn}=\int_{x_p-\Delta x}^{x_p+\Delta x}\int_{y_q-\Delta y}^{y_q} R(x,y)f_x^{mn}(x,y)f_x^{pq}(x,y)dydx$$

-continued $$\begin{aligned}
Z_{xx}^{pqmn} &= \int_{-\infty}^{\infty}\int_{-\infty}^{\infty} G_{xx}(k_x,K_y)\tilde{f}_x^{mn}(k_x,k_y)\tilde{f}_x^{pq}(k_x,k_y)dk_xdk_y \\
&= \int_0^{2\Pi}\int_0^{\infty} G_{xx}(k_x,k_y)\tilde{f}_x^{mn}(k_x,k_y)\tilde{f}_x^{pq}(k_x,k_y)dkd\alpha \\
&= \int_0^{2\Pi}\int_0^{\infty} \{G_{XX}(k_x,k_y)- \\
&\quad G_a(k_x,k_y)\}\tilde{f}_x^{mn}(k_x,k_y)\tilde{f}_x^{pq}(k_x,k_y)dkd\alpha + \\
&\quad \int_0^{2\Pi}\int_0^{\infty} G_a(k_x,k_y)\tilde{f}_x^{mn}(k_x,k_y)\tilde{f}_x^{pq}(k_x,k_y)dkd\alpha \\
&\quad \int_0^{2\Pi}\int_0^{\infty} G_a(k_x,k_y)\tilde{f}_x^{mn}(k_x,k_y)\tilde{f}_x^{pq}(k_x,k_y)dkd\alpha \\
&= \text{Free Space Imedance where } \epsilon_a=(\epsilon_r+1)/2
\end{aligned}$$

Figure 3:
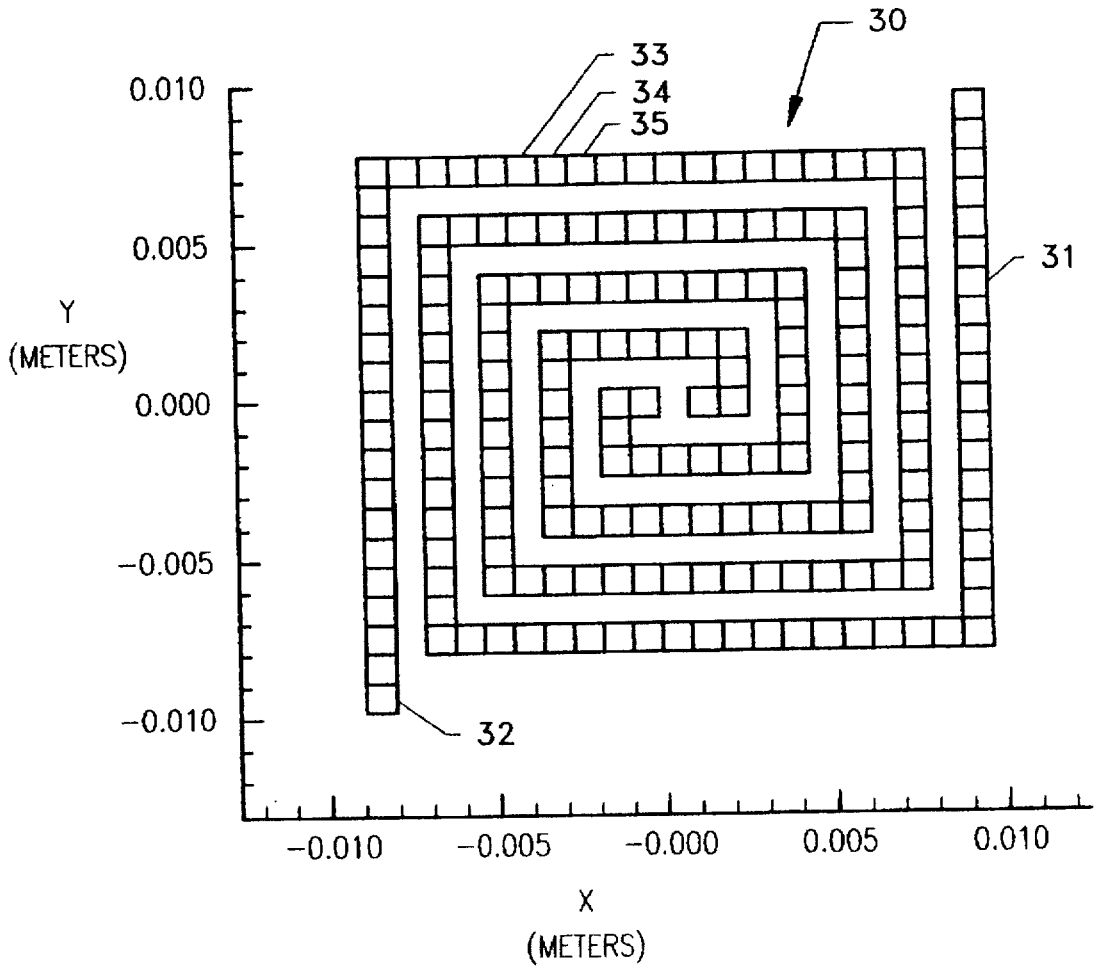
FIG. 3 is a top view of the square spiral of the present invention.
Figure 4:
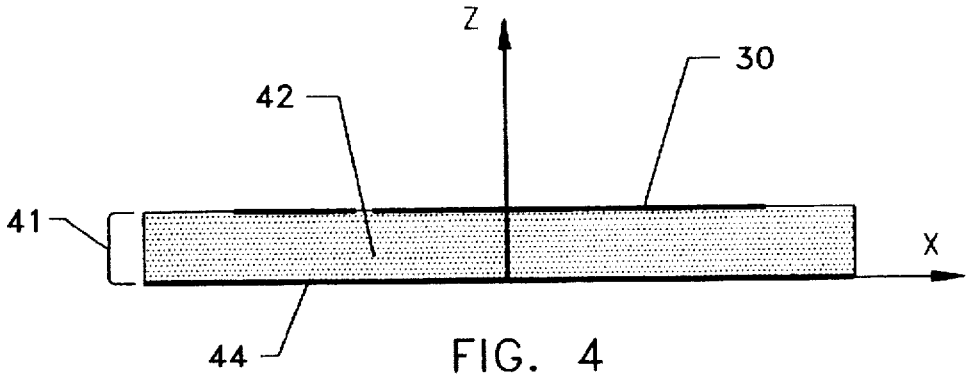
FIG. 4 is a cross sectional side view of the square spiral.

Referring to FIG. 3, the spiral antenna of the present invention 30 is shown in top view. The spiral shown is formed by two arms (31 and 32) but in general can have any number of arms. Each individual element (33, 34, 35) forms a square spiral having a spacing between adjacent arms approximately equal to the width of the spiral arm. As shown in FIG. 4, the single layer spiral 30 is supported by a thin dielectric 42 material with parameters $\epsilon_r$ and $\mu_r$, the relative permitivity and relative permeability, respectively. Typically, the thickness 41 of the dielectric material is 1/16 to ¼ inches. The dielectric slab, fabricated from a dielectric in the preferred embodiment, is attached to a perfectly conducting ground plane 44. An aluminum ground plane is used in the preferred embodiment. There is no electrically lossy material behind the spiral, nor is there any cavity.

Figure 5:
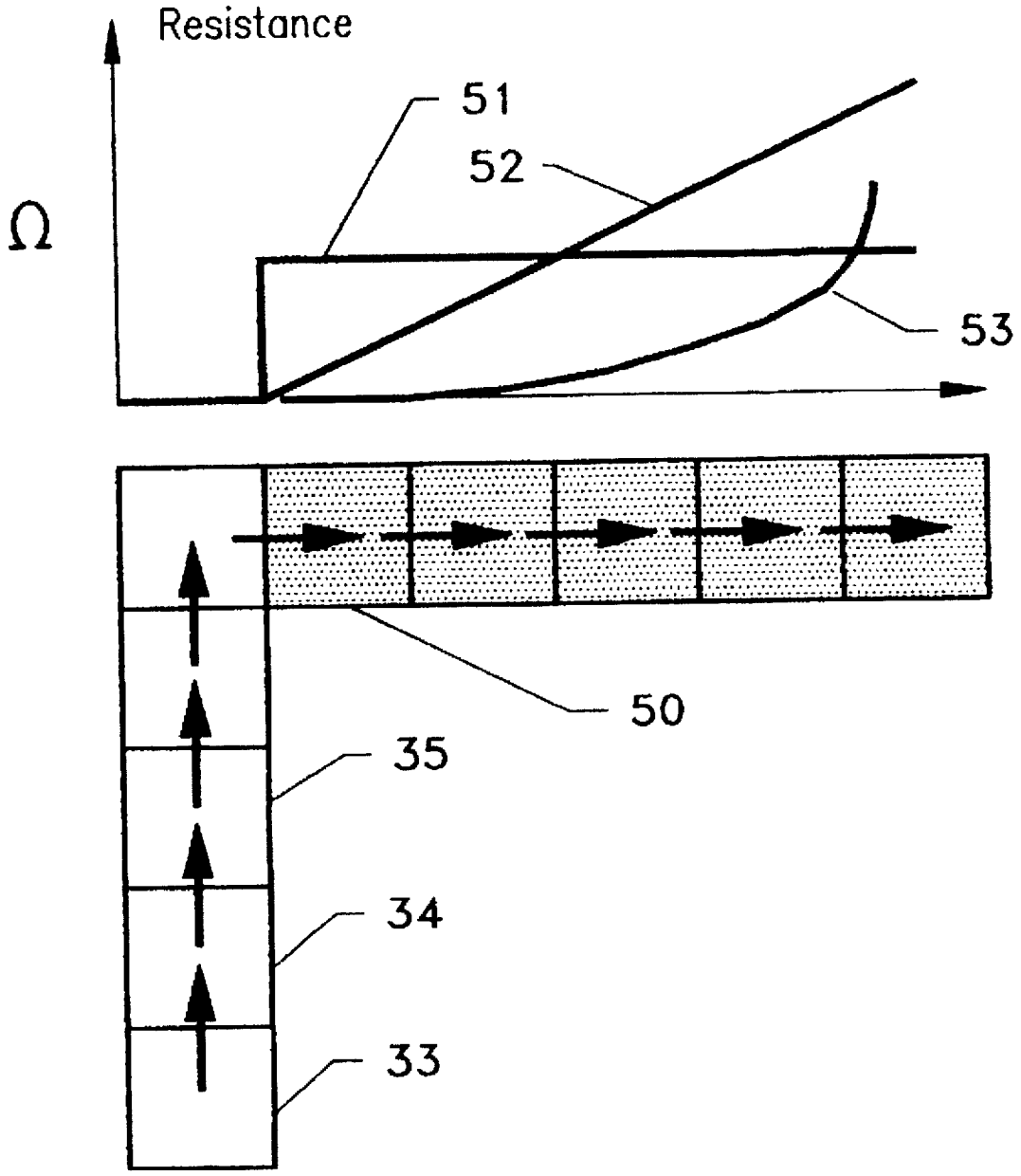
FIG. 5 is a view of a section of a square spiral arm with a graphical representation of resistance.
Figure 7:
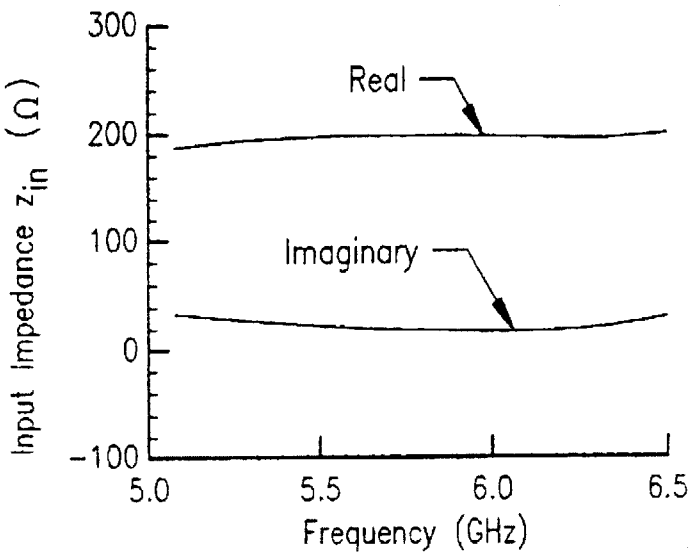
FIG. 7 is a graphical representation of input impedance over a selected frequency range.
Figure 8:
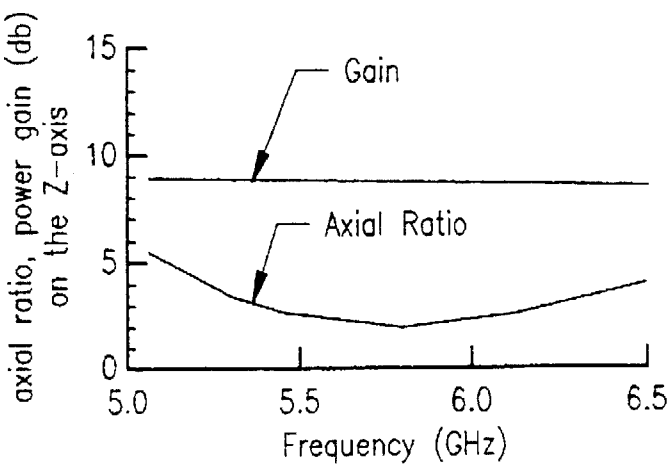
FIG. 8 is a graphical representation of gain and axial ratio along the z axis over a selected frequency range.
Figure 6:
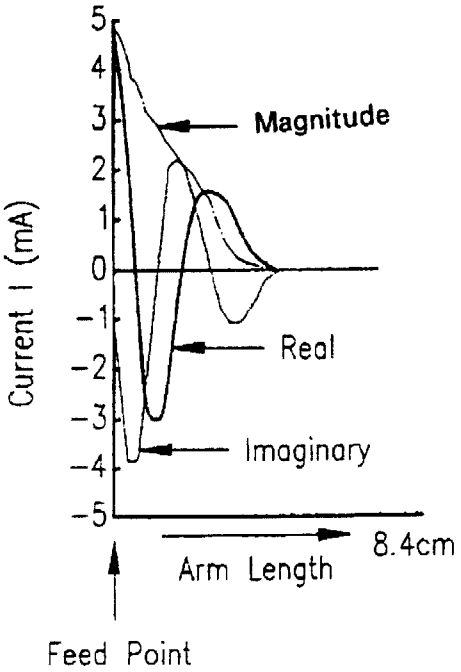
FIG. 6 is a graphical representation of current distribution along the square spiral arms.

Referring to FIG. 5, electrical current elements 33, 34, and 35 in the spiral are shown unshaded representing antenna elements having no added resistance. Antenna element 50 and the following shaded elements are shaded to represent elements having added resistance. Electrical resistance can be placed on a portion of the spiral arms and can be varied as a function of position on the arms. Various types of resistance profiles are shown in FIG. 5. A incremental step increase in resistance is shown in line 51, a linear increase is shown in line 52 and an exponential increase is shown in line 53. At a resistance of 0Ω (ohms) the spiral arm is perfectly conducting. Typical resistance tapers for a spiral would start at 0Ω (ohms) and increase, in steps or in a taper, to a few hundred ohms. Calculation of the antenna performance parameters using a standard Archimedean spiral is shown in FIGS. 6, 7, and 8. FIG. 6 shows the calculated values of current flow compared to antenna arm length using a frequency range in the 5.0–6.5 GHz range. FIG. 7 shows the real and imaginary components of spiral input impedance for same spiral and FIG. 8 shows the expected gain and axial ratios in the direction perpendicular to plane of the antenna spiral.

Figure 9:
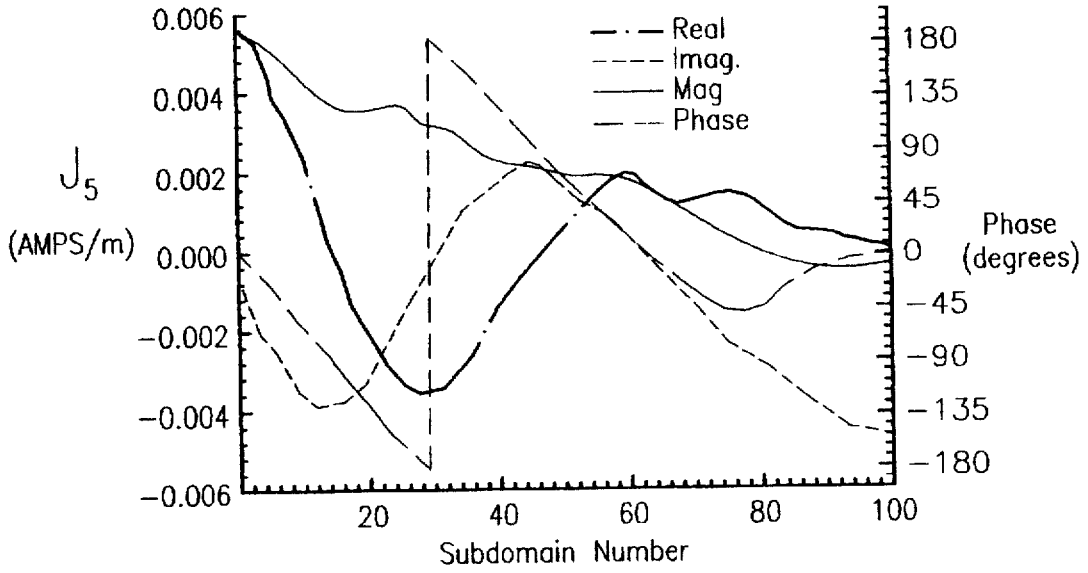
FIG. 9 is a graphical representation of current distribution and phase along a square spiral arm.
Figure 10:
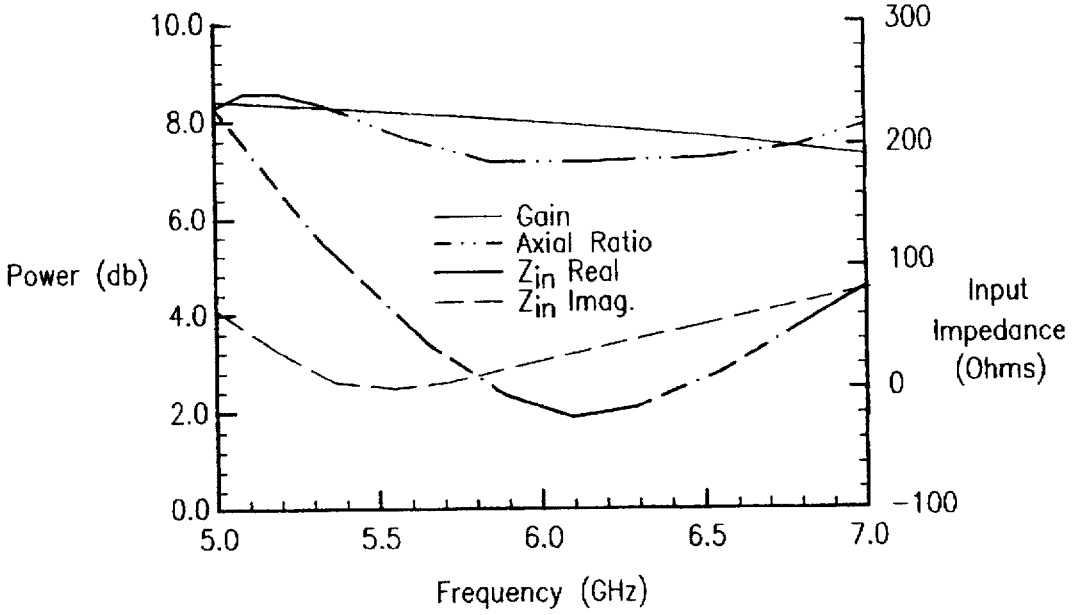
FIG. 10 is a graphical depiction of gain, axial ratio and input impedance for the square spiral antenna.
Figure 11:
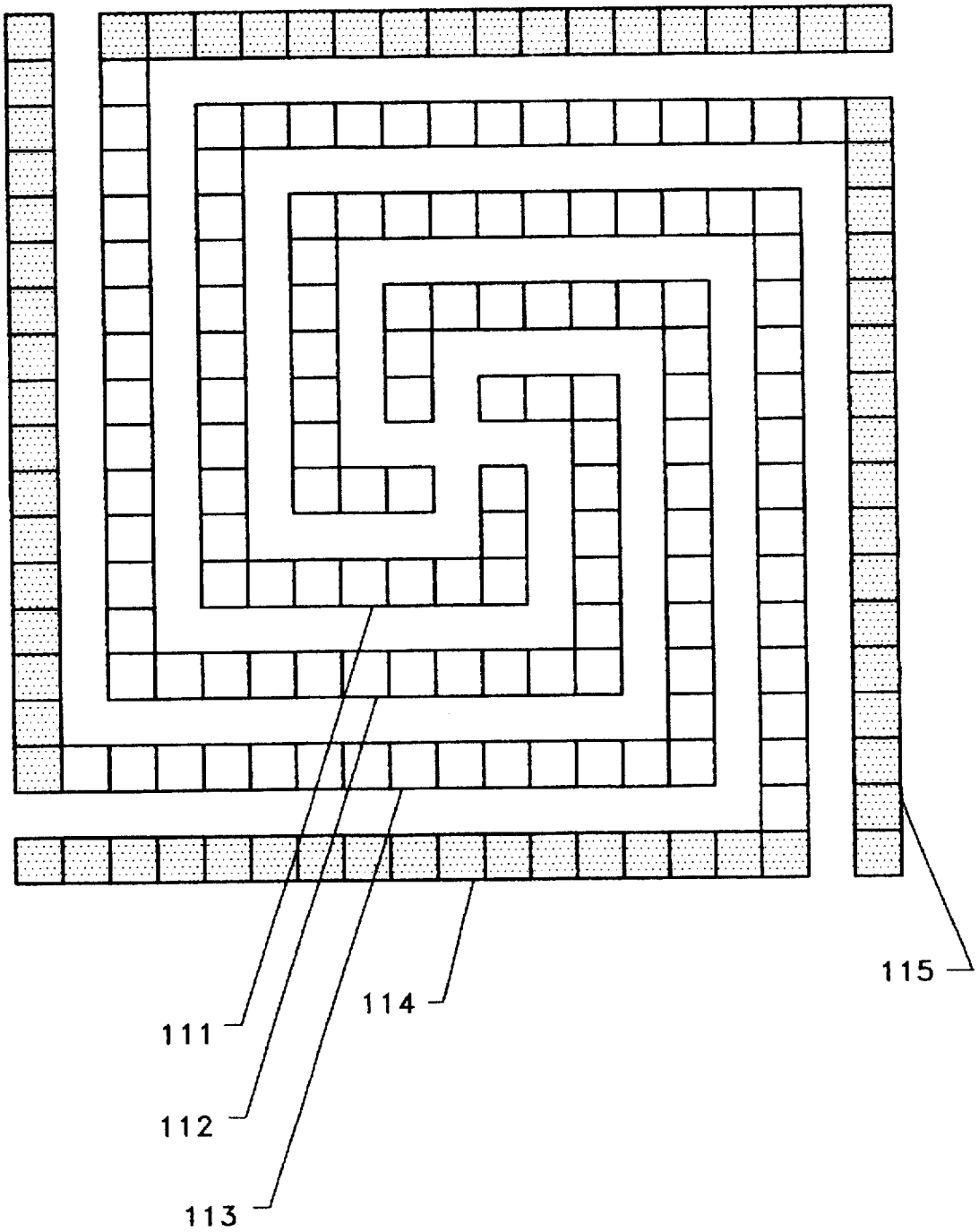
FIG. 11 is an alternate embodiment of the antenna with four spiral arms.

As a comparison, the results of the computer program for the square spiral are shown in FIG. 9. A plot of the current distribution as a function of arm length is plotted against arm length referenced as domain numbers, (percentage of the length). The input impedance, gain, and axial ratio are also evaluated by the computer program. An example is shown in FIG. 10. By examining the distribution of current on the spiral arms, the magnitude of the current is caused to decrease as the current flows out of the arm of the spiral. If the magnitude of the current does not go to zero at the end of the spiral arm, the current will reflect back towards the center of the spiral and produce unwanted radiation. To ensure a smooth decrease in current on the spiral arms, resistance can be placed on the arms of the spiral as in FIG. 5. To achieve a smooth current distribution it is best to have a smooth increase in resistance beginning at 0 ohms. The resistance should be placed so as to absorb any current that remains on the spiral arms after the area of maximum radiation, (a region on the spiral where the circumference of the arms is equal to one free space wavelength). Because the resistance on the arms of the spiral also serves to decrease the gain (especially at the lower frequencies of operation), it is best to use as little resistance as possible while still maintaining an acceptable current distribution on the spiral arms. The resistive portion of the spiral arms could be made of carbon loaded paint or other resistive materials. Smoothly increasing the resistance on the arms is best (so as to avoid reflections of current back along the spiral arms) but a staircased approximation to a smooth curve can be used. Rather than using materials behind the spiral (as in the previous art) to absorb unwanted energy, the new method of analysis and design allows for direct control of the current distribution on the arms of the spiral by using resistance on the arms themselves. The resistance can be placed only on the portion of the arms where the current should be decreased to improve the antenna performance, thereby providing much greater gain. An alternate embodiment is shown is FIG. 11 where a square spiral with four arms 111, 112, 113, 114 is shown. As in the prior figures, the shaded area represents antenna elements 115 having added resistance.

The novel features and advantages of the antenna are numerous. The antenna provides both high gain and wideband performance. Losses due to an underlying cavity are eliminated. The thin flat structure is suitable for conformed mounting on an aircraft surface. The performance is available due to the resistive elements added to the antenna arms and the use of a ground plane to avoid signal losses.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A spiral microstrip antenna comprising:

a ground plane;

a dielectric slab attached to said ground plane; and a single layer comprising a plurality of spiral constant width arms, attached to said dielectric slab, each arm comprising a plurality of electrically resistive and conductive elements having resistance connected to each other, the resistance of each resistive element being matched to the resistance of the preceding elements along the arm, back toward the center of the spiral, to create a tapered gradually increasing resistance.

2. A spiral microstrip antenna as in claim 1 wherein said ground plane comprises an aluminum plate.

3. A spiral microstrip antenna as in claim 1 wherein said dielectric slab comprises a dielectric plastic having a thickness in the range of 1/16 to 1/4 inches.

4. A spiral microstrip antenna as in claim 1 wherein said plurality of spiral arms comprises a pair of spiral arms, each having a constant width and beginning in a center and spiraling outward to form a spacing between adjacent arm segments equal to the width of a spiral arm.

5. A spiral microstrip antenna as in claim 1 wherein said plurality of spiral arms comprises four spiral arms, each having a constant width and beginning in a center and spiraling outward to form a spacing between adjacent arm segments equal to the width of a spiral arm.

6. A spiral microstrip antenna as in claim 1 wherein said plurality of spiral arms comprises a pair of spiral arms having a constant width and forming a square spiral, each arm spiraling outward to form spacing between adjacent arm segments equal to the width of a spiral arm.

7. A spiral microstrip antenna as in claim 1 wherein said plurality of spiral arms comprises four spiral arms forming a square spiral, each arm having a constant width and spiraling outward to form spacing between adjacent arm segments equal to the width of a spiral arm.

* * * * *